US009121583B2

(12) United States Patent
Takeuchi

(10) Patent No.: US 9,121,583 B2
(45) Date of Patent: Sep. 1, 2015

(54) ILLUMINATION APPARATUS FOR SHOWCASE

(76) Inventor: Takafumi Takeuchi, Sabae (JP)

( * ) Notice: Subject to any disclaimer, the term of this patent is extended or adjusted under 35 U.S.C. 154(b) by 46 days.

(21) Appl. No.: 13/816,155

(22) PCT Filed: Nov. 15, 2011

(86) PCT No.: PCT/JP2011/076224

§ 371 (c)(1),
(2), (4) Date: Mar. 5, 2013

(87) PCT Pub. No.: WO2012/086339

PCT Pub. Date: Jun. 28, 2012

(65) Prior Publication Data

US 2013/0286651 A1 Oct. 31, 2013

(30) Foreign Application Priority Data

Dec. 22, 2010 (JP) ..... 2010-285908

(51) Int. Cl.

| | |
|---|---|
| ***F21S 4/00*** | (2006.01) |
| ***F21V 17/02*** | (2006.01) |
| ***A47F 11/10*** | (2006.01) |
| ***F21K 99/00*** | (2010.01) |

(52) U.S. Cl.

CPC ..... *F21V 17/02* (2013.01); *A47F 11/10* (2013.01); *F21K 9/00* (2013.01)

(58) Field of Classification Search

CPC ..... G02F 1/133603; G02B 6/0073; F21V 33/0012; F21Y 2103/003; F21W 2131/301; F21W 2131/405

USPC ..... 362/127, 133, 134, 221, 234, 249.02, 362/253, 602, 603, 604, 630, 631

See application file for complete search history.

(56) References Cited

U.S. PATENT DOCUMENTS

| | | | | |
|---|---|---|---|---|
| 8,746,916 | B2 | 6/2014 | Oketani et al. | |
| 2007/0133202 | A1 * | 6/2007 | Huang et al. | 362/235 |

FOREIGN PATENT DOCUMENTS

| | | | |
|---|---|---|---|
| CN | 101791180 | A | 8/2010 |
| DE | 202009010551 | U1 | 1/2010 |
| JP | 1984-174050 | U | 11/1984 |

(Continued)

OTHER PUBLICATIONS

PCT, "International Search Reportfor PCT/JP2011/076224", Mar. 13, 2012.

(Continued)

*Primary Examiner* — Meghan Dunwiddie
(74) *Attorney, Agent, or Firm* — Manabu Kanesaka

(57) ABSTRACT

An illumination apparatus (13) is configured so that the position of a pair of power supply terminals can be arbitrarily adjusted in the rightward/leftward direction corresponding to the interval between posts, and the position of the illumination apparatus can be arbitrarily adjusted in the forward/backward direction corresponding to the length of shelf supports. The illumination apparatus (13) includes a pair of power supply terminals (14, 15). The power supply terminal (14) (positive power supply terminal) comes in contact with a shelf support (6), and the power supply terminal (15) (negative power supply terminal) comes in contact with a shelf support (7) to supply power to the illumination apparatus (13). The illumination apparatus (13) is positioned between a shelf board (8) and the shelf supports (6, 7) via the power supply terminals (14, 15).

4 Claims, 6 Drawing Sheets

(56) References Cited

FOREIGN PATENT DOCUMENTS

| | | | |
|---|---|---|---|
| JP | 1993-079806 | U | 10/1993 |
| JP | 2004-344507 | A | 12/2004 |
| JP | 2010-167210 | A | 8/2010 |
| JP | 2010-170970 | A | 8/2010 |

OTHER PUBLICATIONS

China Patent Office, "Office Action for CN 201180037132.6," Aug. 5, 2014.

* cited by examiner

ILLUMINATION APPARATUS FOR SHOWCASE

TECHNICAL FIELD

The invention relates to an illumination apparatus for a display shelf (display rack or showcase) that is used to display goods.

BACKGROUND ART

Patent Document 1 discloses an illumination apparatus that illuminates a display shelf by causing electricity to flow directly through posts and shelf supports. Patent Document 2 discloses technology that utilizes a tape-shaped LED substrate as an illumination apparatus for a display shelf.

RELATED-ART DOCUMENT

Patent Document

Patent Document 1: JP-A-2004-344507
Patent Document 2: JP-A-2010-170970

SUMMARY OF THE INVENTION

Technical Problem

According to the technology disclosed in Patent Document 1, since low-voltage electricity (e.g., 12 V) is caused to flow directly through the posts and the insulated clawed shelf supports of the display shelf to emit light from a spotlight, the entire shelf cannot be illuminated brightly. The entire shelf may be illuminated using an illumination apparatus such as a fluorescent lamp that is driven at a low voltage instead of using a spotlight. In this case, however, since it is necessary to use a large illumination apparatus, the display range decreases. In particular, such an illumination apparatus is not suitable for a display shelf (e.g., glass showcase) for which an excellent appearance is desired.

Patent Document 2 discloses an illumination apparatus that is provided under a shelf board of a showcase, a display shelf, or the like, and includes a main body that is formed of an aluminum profile and is provided with a tape-shaped substrate on which a plurality of LED are linearly disposed, and a transparent resin cover that covers the entire main body in the widthwise direction, wherein the side of the main body on which the LED substrate is mounted is formed in the shape of the letter "V", and the transparent resin cover has a flat bottom, and is approximately formed in the shape of the letter "U". However, since the illumination apparatus disclosed in Patent Document 2 has a constant length, the length of the illumination apparatus cannot be appropriately adjusted corresponding to the width of the display shelf.

Japanese Patent Application No. 2010-199339 that was applied for by the applicant of the present application discloses a display shelf that is configured so that low-voltage electricity is applied to posts and shelf supports, wherein the shelf support made of a metal is fitted into a hole formed in each post, the shelf board is placed on the shelf support to determine the vertical position of the shelf board, an LED tape on which a plurality of high-brightness LED are arranged in a row is bonded to the lower side of each shelf board, and each terminal of the LED tape comes in contact with the shelf support to form an illumination apparatus integrally with the shelf board. The technology disclosed in Japanese Patent Application No. 2010-199339 can solve the problem that occurs when using the technology disclosed in Patent Document 1. The technology disclosed in Japanese Patent Application No. 2010-199339 poses no problem when producing a new display shelf. However, since existing shelves may differ in the width of the shelf board, the interval between the posts, and the shape of the shelf support, it is troublesome to deal with such a difference when using the technology disclosed in Japanese Patent Application No. 2010-199339.

The invention was conceived in view of the above problems. An object of the invention is to make it possible to easily mount an illumination apparatus on a display shelf by providing an illumination apparatus that is mounted on a display shelf configured so that low-voltage power is applied to posts and shelf supports, and includes a tape-shaped substrate on which a plurality of LED are linearly disposed, wherein the position of a pair of power supply terminals can be arbitrarily adjusted in the rightward/leftward direction corresponding to the interval between the posts, and the position of the pair of power supply terminals can be arbitrarily adjusted in the forward/backward direction corresponding to the length of the shelf supports by positioning the illumination apparatus and the pair of power supply terminals between a shelf board and the shelf supports.

Solution to Problem

According to one aspect of the invention, there is provided an illumination apparatus that is mounted on a display shelf that is configured so that low-voltage power is applied to posts and shelf supports, and includes a tape-shaped substrate on which a plurality of LED are linearly disposed, the illumination apparatus including:

a tape-shaped LED substrate, a plurality of LED being disposed in a center area of the LED substrate in a shape of a band, and a positive terminal band and a negative terminal band being disposed on the LED substrate on either side of the plurality of LED;

a main body that is formed in a shape of a band, and has U-shaped slide grooves on either side, the LED substrate being bonded to the main body in an area between the slide grooves; and a pair of power supply terminals that are fitted into the slide grooves of the main body, and electrically connected to the shelf support and the positive terminal band or the negative terminal band of the LED substrate, the illumination apparatus being configured so that a position of the pair of power supply terminals can be arbitrarily adjusted in a rightward/leftward direction corresponding to an interval between the posts, and a position of the pair of power supply terminals can be arbitrarily adjusted in a forward/backward direction corresponding to a length of the shelf supports by positioning the illumination apparatus and the pair of power supply terminals between a shelf board and the shelf supports.

Advantageous Effects of the Invention

Since the illumination apparatus according to one aspect of the invention is configured so that the pair of power supply terminals can be fitted into the slide grooves of the main body, and can be arbitrarily slid along the slide grooves, the position of the pair of power supply terminals can be adjusted corresponding to the position of the posts. Moreover, since the main body is positioned between the shelf board and the shelf supports via the pair of power supply terminals, the position of the pair of power supply terminals can be arbitrarily adjusted in the forward/backward direction corresponding to the length of the shelf supports or the width of the shelf board. This makes it possible to easily mount the illumination apparatus on the existing display shelf.

Since the illumination apparatus is positioned between the shelf board and the shelf supports, a plurality of illumination apparatuses can be easily mounted on a single shelf board. Therefore, it is possible to increase the illumination intensity, as required.

Since the plurality of LED are disposed in the center area of the LED substrate, and the positive terminal band and the negative terminal band are disposed on the LED substrate on either side of the plurality of LED, the LED substrate can be arbitrarily cut in an area (several centimeters) between the LED to have a dimension corresponding to the width of the shelf board.

BRIEF DESCRIPTION OF THE DRAWINGS

FIG. 3(2) is a bottom view thereof; and FIG. 3(3) is a right side view thereof.

FIG. 4(2) is a right side view illustrating an embodiment in which the illumination apparatus is fitted into a recess formed in the shelf board.

FIG. 5(2) is a bottom view thereof; and FIG. 5(3) is a right side view thereof.

FIG. 6(2) is a bottom view thereof; and FIG. 6(3) is a right side view thereof.

FIG. 7(2) is a bottom view thereof; FIG. 7(3) is a right side view thereof; FIG. 7(4) is a cross-sectional view thereof on the left side in FIG. 7(2); and FIG. 7(5) is a cross-sectional view thereof on the right side in FIG. 7(2).

FIG. 8(2) illustrates the shelf support having an I-shaped cross-sectional shape.

FIG. 10(2) is a bottom view thereof; FIG. 10(3) is a front view of a connection adaptor; and FIG. 10(4) is a right side view of the connection adaptor.

DESCRIPTION OF EMBODIMENTS

Figure 1:
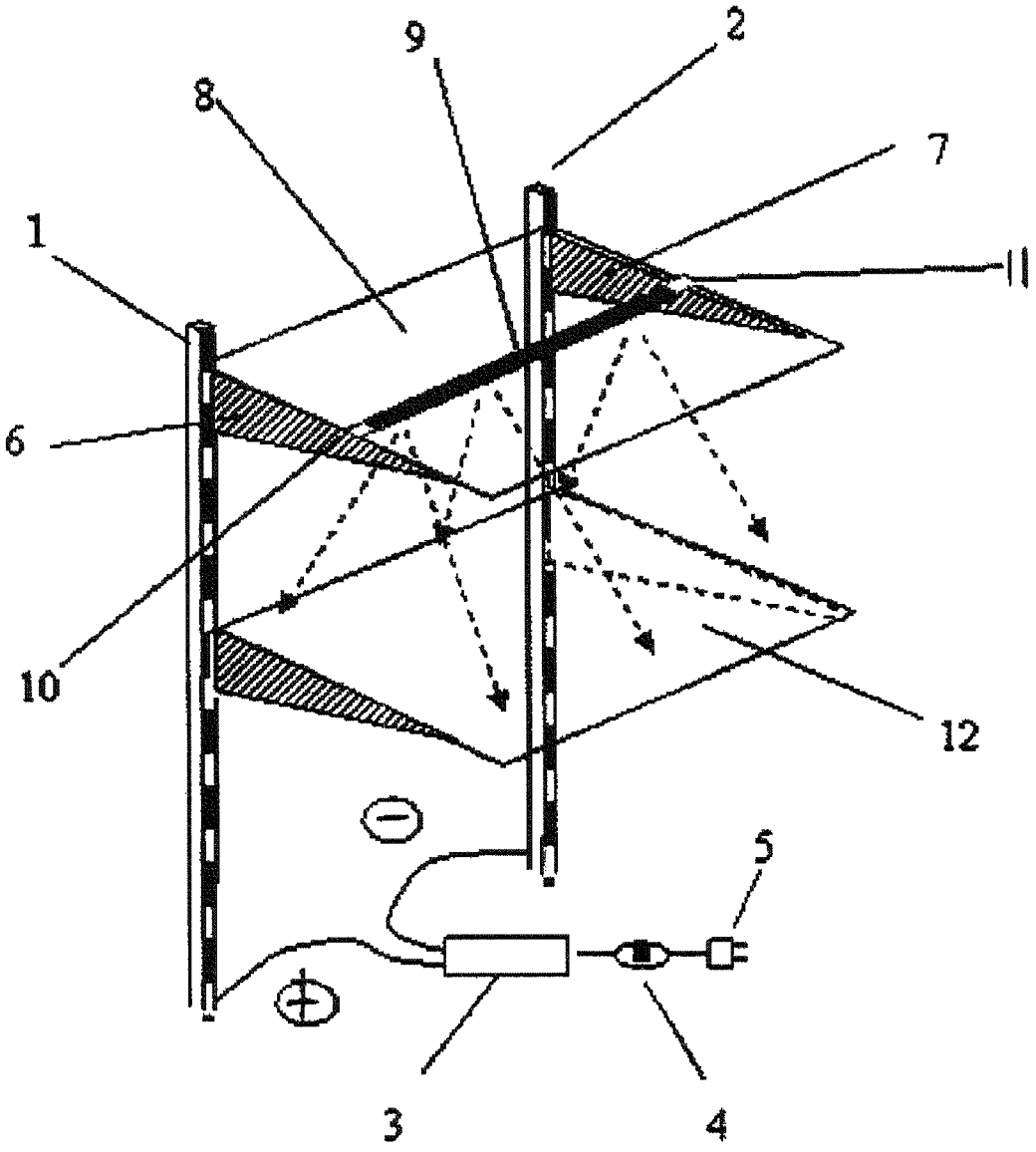
FIG. 1 is a schematic view illustrating an outline of one embodiment of the invention.

A first embodiment of the invention is described below with reference to FIGS. 1 to 9. FIG. 1 is a schematic view illustrating an outline of the invention disclosed in Japanese Patent Application No. 2010-199339.

Reference sign 1 indicates a left post made of a metal, and reference sign 2 indicates a right post made of a metal. The left post 1 and the right post 2 are respectively connected to a positive terminal and a negative terminal of a power supply adaptor 3. The power supply adaptor 3 is connected to an AC power supply through a switch 4 and an AC power supply plug 5, and supplies a DC voltage of 12 V to the posts 1 and 2.

Reference signs 6 and 7 indicate shelf supports made of a metal. The shelf support 6 is fitted into a hole formed in the left post 1, and the shelf support 7 is fitted into a hole formed in the right post 2. A shelf board 8 is placed on the shelf supports 6 and 7 to position the shelf in the vertical direction. The upper shelf board 8 is made of glass, for example. An LED tape 9 on which a plurality of high-brightness LED are arranged in a row is attached to the lower side of the shelf board 8, and a positive terminal 10 and a negative terminal 11 of the LED tape 9 respectively come in contact with the shelf supports 6 and 7. Note that reference sign 12 indicates a lower shelf board. Goods are placed on the lower shelf board 12, and illuminated by light emitted from the LED tape 9 (see the broken arrows in FIG. 1).

Figure 2:
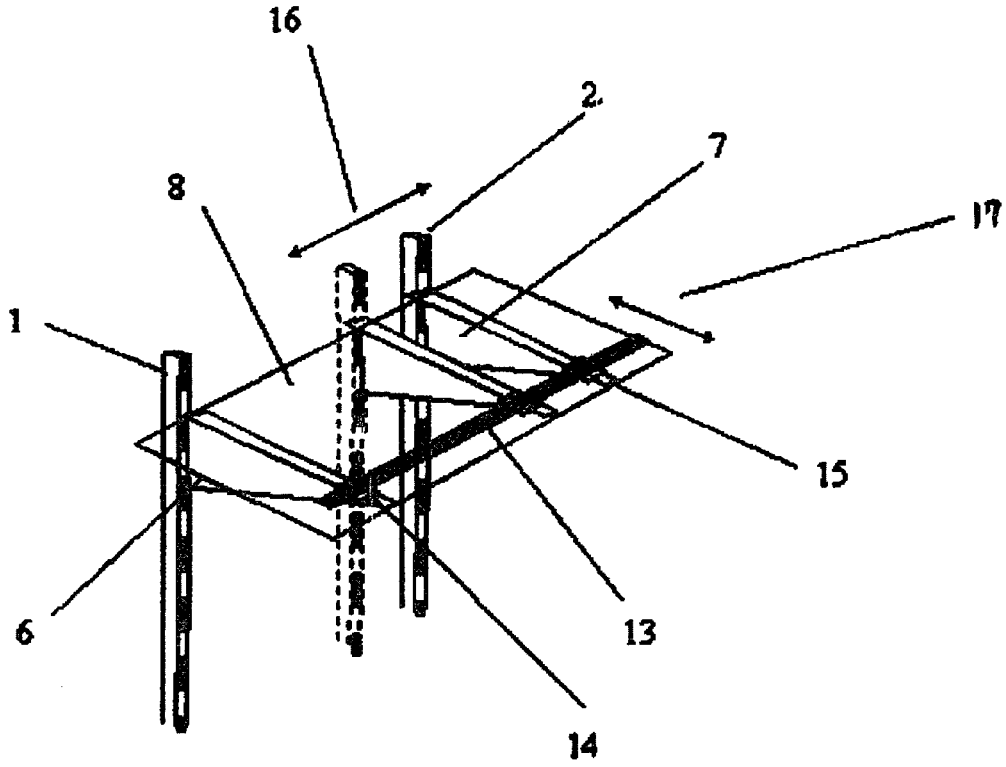
FIG. 2 is a schematic view illustrating an outline of one embodiment of the invention.

FIG. 2 is a schematic view illustrating an outline of the invention. A pair of power supply terminals 14 and 15 is attached to an illumination apparatus 13. The power supply terminal 14 (positive power supply terminal) comes in contact with a shelf support 6, and the power supply terminal 15 (negative power supply terminal) comes in contact with a shelf support 7 to supply power to the illumination apparatus 13. The illumination apparatus 13 is positioned between a shelf board 8 and the shelf supports 6 and 7 via the power supply terminals 14 and 15. When the post 2 is positioned on the inner side, the power supply terminal 15 can be slid inward so that the power supply terminal 15 is positioned corresponding to the post 2 (see the arrow 16 in FIG. 2). The illumination apparatus 13 can also be moved forward and backward (see the arrow 17 in FIG. 2).

Figure 3:
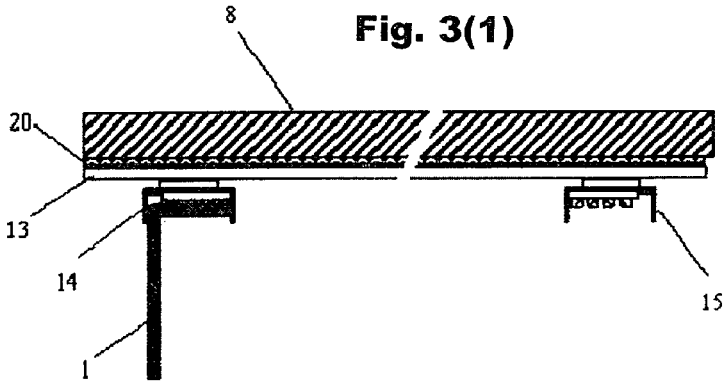
FIGS. 3(1)-3(3) are detailed views illustrating the entire illumination apparatus; wherein FIG. 3(1) is a front view thereof.
Figure 3:
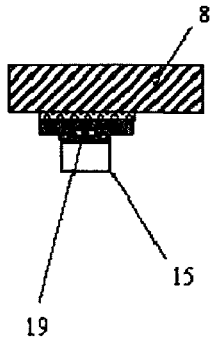
Figure 3:
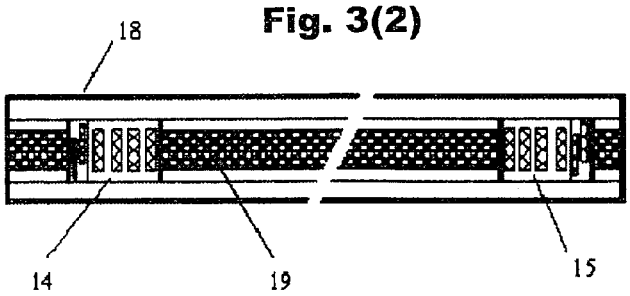

FIGS. 3(1)-3(3) are detailed views illustrating the entire illumination apparatus 13, wherein FIG. 3(1) is a front view, FIG. 3(2) is a bottom view, FIG. 3(3) is a right side view). The illumination apparatus 13 is positioned between the shelf board 8 and the shelf support 6 (7) via the power supply terminal 14 (15), and supplies power to an LED substrate 19 attached to a main body 18. Note that the main body 18 may be secured using a double-sided pressure-sensitive adhesive tape 20 or the like.

Figure 4:
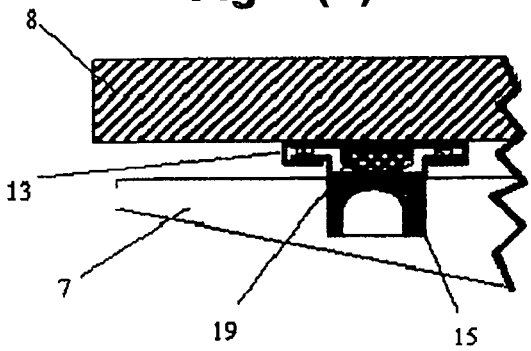
FIGS. 4(1), 4(2) are detailed views illustrating an installation state of an illumination apparatus; wherein FIG. 4(1) is a right side view illustrating a state in which the illumination apparatus is placed between a shelf board and a shelf support.
Figure 4:
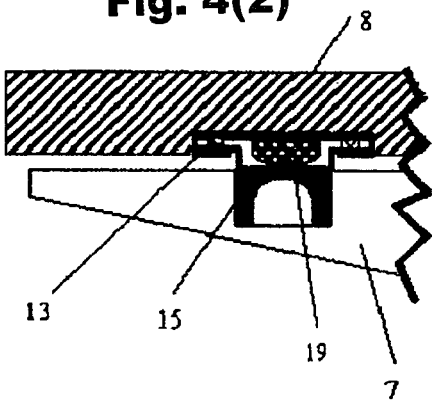

FIG. 4(1) is a right side view further illustrating a state in which the illumination apparatus 13 is placed between the shelf board 8 and the shelf support 7. FIG. 4(2) also illustrates an embodiment in which the illumination apparatus 13 is fitted into a recess formed in the shelf board 8. In this case, the position of the illumination apparatus 13 in the forward/backward direction is fixed. However, since the illumination apparatus 13 is embedded in the shelf board 8, it is possible to obtain a sophisticated display shelf having excellent appearance.

Figure 5:
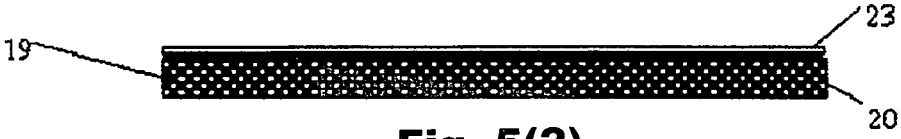
FIGS. 5(1)-5(3) are detailed views illustrating an LED substrate; wherein FIG. 5(1) is a front view thereof.
Figure 5:
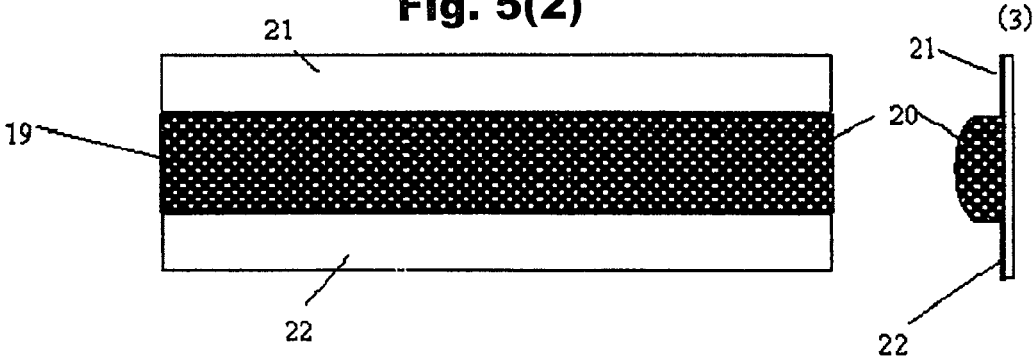

FIGS. 5(1)-5(3) illustrate the details of the LED substrate 19, wherein FIG. 5(1) is a front view, FIG. 5(2) is a bottom view, FIG. 5(3) is a right side view). The LED substrate 19 is a tape-shaped substrate on which a plurality of LED 20 are linearly disposed. The plurality of LED 20 are connected in parallel in the center area of the LED substrate 19, and a positive terminal band 21 and a negative terminal band 22 are provided on either side of the plurality of LED 20. Therefore, light is emitted from each LED 20 emit light by supplying power from an arbitrary position of the positive terminal band 21 and the negative terminal band 22. Note that reference sign 23 indicates a pressure-sensitive adhesive tape for bonding the tape-shaped substrate to the main body 18.

Figure 6:
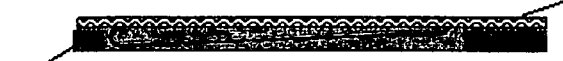
FIGS. 6(1)-6(3) are detailed views illustrating a main body; wherein FIG. 6(1) is a front view thereof.
Figure 6:
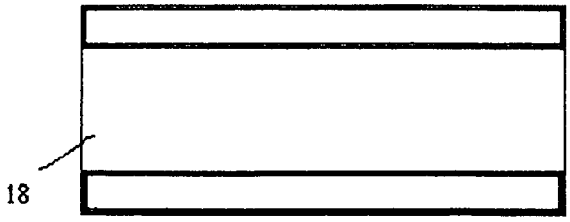
Figure 6:
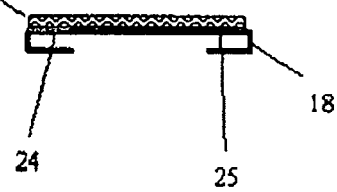

FIGS. 6(1)-6(3) illustrate the details of the main body 18, wherein FIG. 6(1) is a front view, FIG. 6(2) is a bottom view, FIG. 6(3) is a right side view). The main body 18 is formed of a plastic that exhibits high transparency, for example. The main body 18 is formed in the shape of a band, and has U-shaped slide grooves 24 and 25 on either side. The main body 18 can be easily cut to have appropriate dimensions corresponding to the width of the shelf board. Note that reference sign 26 indicates a double-sided tape or the like that is provided so that the main body 18 can optionally be bonded to the shelf board or the like.

Figure 7:
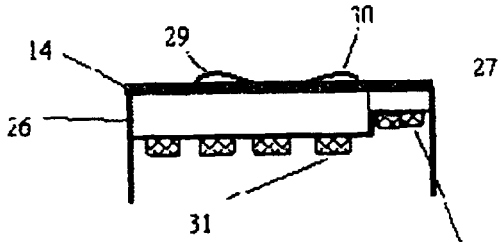
FIGS. 7(1)-7(5) are detailed views illustrating a power supply terminal; wherein FIG. 7(1) is a front view thereof.
Figure 7:
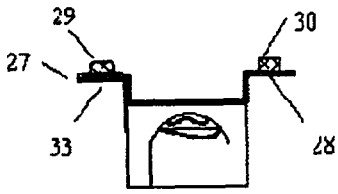
Figure 7:
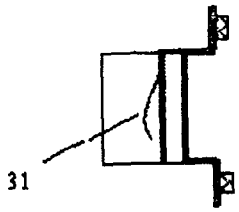
Figure 7:
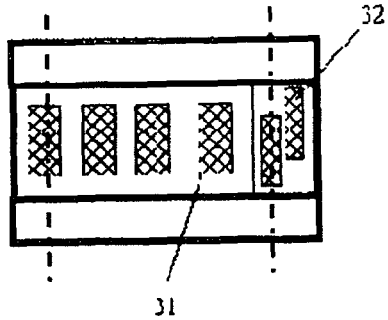
Figure 7:
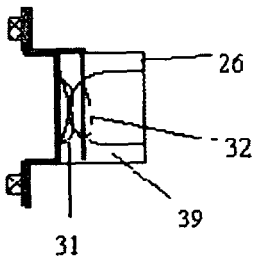

FIGS. 7(1)-7(5) illustrate the details of the power supply terminal 14 (15), wherein FIG. 7(1) is a front view, FIG. 7(2) is a bottom view, FIG. 7(3) is a right side view, FIG. 7(4) is a cross-sectional view on the left side in FIG. 7(2), FIG. 7(5) is a cross-sectional view on the right side in FIG. 7(2)). A main body 26 of the power supply terminal 14 is formed of an insulator (e.g., reinforced plastic). A conductive leaf spring contact 29 is attached to the upper side of a left arm section 27, and a conductive leaf spring contact 30 is attached to the upper side of a right arm section 28. The contact 29 is electrically connected to the positive terminal band 21 of the LED substrate 19. The arm sections 27 and 28 are respectively fitted into the slide grooves 24 and 25 of the main body 18 so that the power supply terminal 14 can be slid along the slide grooves 24 and 25. Reference signs 31 and 32 indicate leaf spring contacts. The leaf spring contacts 31 and 32 come in electrical contact with the shelf support 6 (7). Note that a wire 33 is provided so that one of the contacts 29 and 30 respectively attached to the arm sections 27 and 28 can be electrically connected to the contacts 31 and 32.

Figure 8:
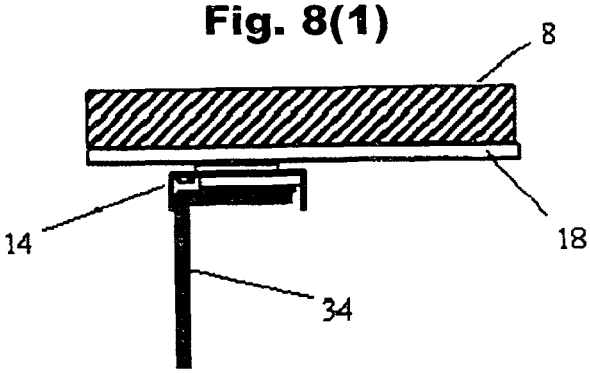
FIGS. 8(1), 8(2) are schematic views illustrating a state in which a shelf support comes in contact with a power supply terminal; wherein FIG. 8(1) illustrates the shelf support having an L-shaped cross-sectional shape.
Figure 8:
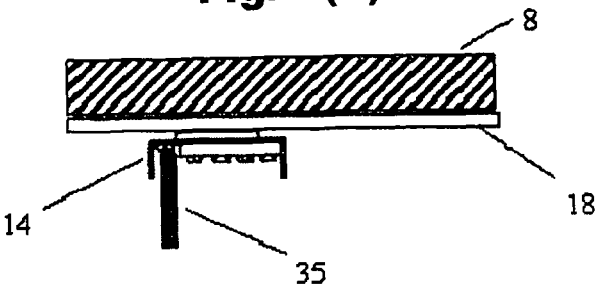
Figure 9:
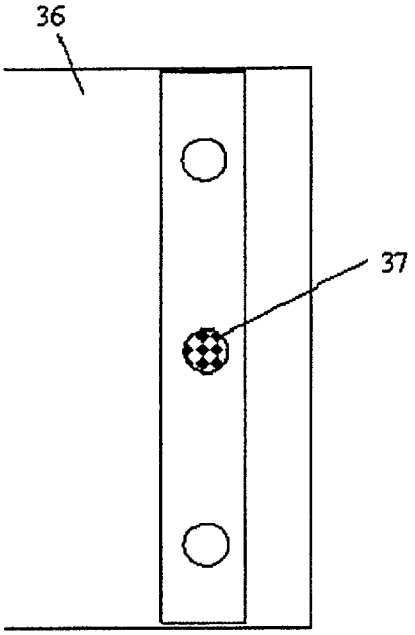
FIGS. 9(1), 9(2) are schematic views illustrating a state in which a shelf support comes in contact with a power supply terminal.
Figure 9:
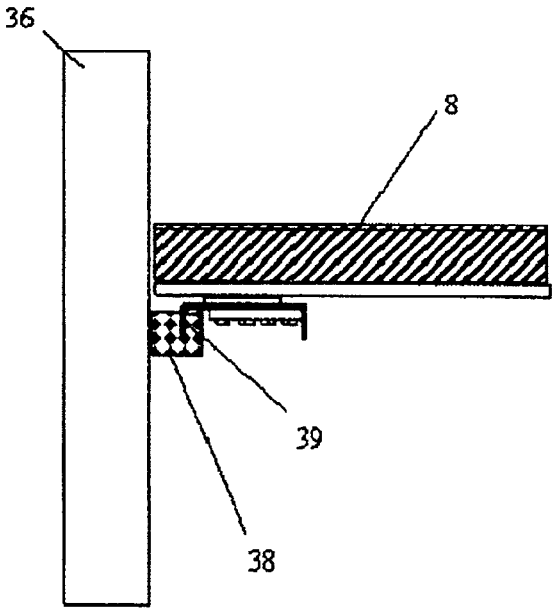

FIGS. 8(1), 8(2) are schematic views illustrating a state in which the shelf support comes in contact with the power supply terminal. As illustrated in FIG. 8(1), when the shelf support is a shelf support 34 that has an L-shaped cross-sectional shape, the shelf support 34 comes in surface contact with the contact 31 of the power supply terminal 14. When the shelf support is a shelf support 35 that has an I-shaped cross-sectional shape (see FIG. 8(2)), the shelf support 35 comes in contact with the contact 32. FIGS. 9(1), 9(2) illustrate an example in which the shelf board 8 is placed on a dowel 38 that is fitted into one of a plurality of dowel holes 37 formed in a shelf side surface 36 (e.g., showcase). In this case, the dowel 38 is secured by a U-shaped dowel guide plate 39 provided to the power supply terminal 14 (15) (see FIGS. 7(1)-7(5)), and electrically connected to the contact 32.

Therefore, the above configuration can be applied to various display shelves (showcases) since the power supply terminal can absorb the difference in shape (e.g., L shape, I shape, or dowel type) of the shelf support.

Figure 10:
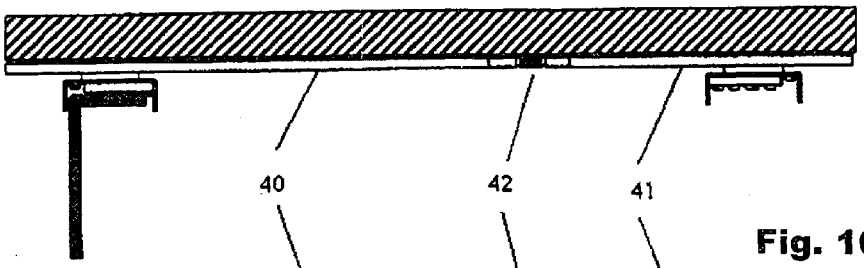
FIGS. 10(1)-10(4) are configuration diagrams illustrating a second embodiment; wherein FIG. 10(1) is a front view thereof.
Figure 10:
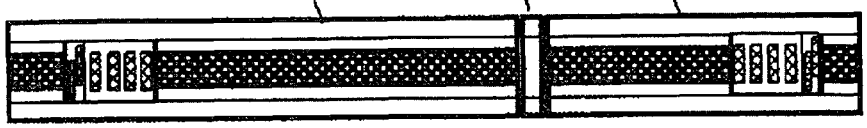
Figure 10:
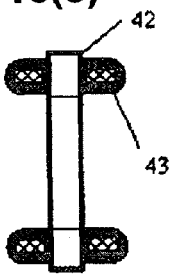
Figure 10:
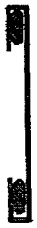

FIGS. 10(1)-10(4) illustrate a second embodiment of the invention, wherein FIG. 10(1) is a front view, FIG. 10(2) is a bottom view, FIG. 10(3) is a front view of connection adaptor, FIG. 10(4) is a right side view of connection adaptor). As illustrated in FIGS. 10(1)-10(4), an illumination apparatus 40 (length: 90 cm, for example) and an illumination apparatus 41 (length: 30 cm, for example) are connected via a connection adaptor 42. An insertion hole is formed in each end of the illumination apparatuses 40 and 41. An insertion section 43 that is in the shape of a leaf spring and is provided on each end of the connection adaptor 42 is inserted into the insertion hole, so that the illumination apparatuses 40 and 41 are connected to each other, and the positive terminal band and the negative terminal band of each LED substrate are respectively connected to each other.

The illumination apparatus according to the second embodiment can be easily applied to a long shelf by connecting a plurality of the illumination apparatuses having a predetermined length (e.g., 90 cm, 60, cm, or 30 cm) via the connection adaptor.

Although only some embodiments of the invention have been described in detail above, the invention is not limited to the above embodiments. Those skilled in the art will readily appreciate that many modifications are possible in the embodiments without materially departing from the novel teachings and advantages of the invention.

REFERENCE SIGNS LIST

1, 2 Post
3 Power supply adapter
6, 7 Shelf support
8 Shelf board
13 Illumination apparatus
14, 15 Power supply terminal
18 Main body

The invention claimed is:

1. An illumination apparatus comprising:

a display shelf including posts having a predetermined distance spaced apart from each other, a shelf board, and shelf supports connected to the posts to support the shelf board, the display shelf being configured so that low-voltage power is applied to the posts and the shelf supports;

a tape-shaped LED substrates;

a plurality of LEDs linearly disposed in a center area of the LED substrate in a shape of a band;

a positive terminal band disposed on the LED substrate on one side of the plurality of LEDs;

a negative terminal band disposed on the LED substrate on another side of the plurality of LEDs opposite to the one side;

a main body formed in a shape of a band, and having U-shaped slide grooves each being disposed on each side of the main body along a length direction thereof to attach the LED substrate between the slide grooves; and a pair of power supply terminals fitted into the slide grooves of the main body, and electrically connected to the shelf support and the positive terminal band or the negative terminal band of the LED substrate, wherein the main body is disposed between the shelf board and the shelf supports of the display shelf so that a position of the pair of power supply terminals is adjusted in the length direction to correspond to an interval between the posts, and a position of the pair of power supply terminals is adjusted in a width direction of the main body to correspond to a length of the shelf supports.

2. An illumination apparatus according to claim 1, wherein the plurality of LEDs is linearly disposed from one end of the LED substrate to another end of the LED substrate in the length direction and arranged on a bottom surface of the LED substrate, and the positive and negative terminal bands are disposed from the one end of the LED substrate to another end of the LED substrate in the length direction and arranged on the bottom surface of the LED substrate so that the plurality of LEDs is arranged between the positive and negative terminal bands to electrically connect to the positive and negative terminal bands.

3. An illumination apparatus according to claim 2, wherein each of the U-shaped slide grooves extends from one end of the main body to another end of the main body in the length direction on each side of the main body so that the U-shaped slide grooves face each other to attach the LED substrate therebetween, and the positive and negative terminal bands contact the U-shaped slide grooves.

4. An illumination apparatus according to claim 3, wherein the pair of power supply terminals is arranged at ends of the slide grooves so that the LED substrate is arranged therebetween.

* * * * *